US008820867B2

(12) United States Patent
Honglin

(10) Patent No.: US 8,820,867 B2
(45) Date of Patent: Sep. 2, 2014

(54) CONTROL CIRCUIT FOR LIGHT EMITTING DIODE INDICATOR

(75) Inventor: Pan Honglin, Singapore (SG)

(73) Assignee: Eastman Kodak Company, Rochester, NY (US)

( * ) Notice: Subject to any disclaimer, the term of this patent is extended or adjusted under 35 U.S.C. 154(b) by 180 days.

(21) Appl. No.: 13/400,178

(22) Filed: Feb. 20, 2012

(65) Prior Publication Data

US 2013/0215166 A1 Aug. 22, 2013

(51) Int. Cl.
*B41J 29/38* (2006.01)

(52) U.S. Cl.
USPC ..... 347/5; 347/9; 399/82

(58) Field of Classification Search
USPC ..... 347/5, 9, 12, 15; 315/129; 399/82
See application file for complete search history.

(56) References Cited

U.S. PATENT DOCUMENTS

| | | | | |
|---|---|---|---|---|
| 7,350,902 | B2 | 4/2008 | Dietl et al. | |
| 7,949,278 | B2 * | 5/2011 | Ogawa | 399/82 |
| 2006/0138967 | A1 * | 6/2006 | Zhou et al. | 315/129 |

* cited by examiner

*Primary Examiner* — Lam S Nguyen
(74) *Attorney, Agent, or Firm* — Peyton C. Watkins

(57) ABSTRACT

A control circuit for a light emitting diode for indicating power-on in a normal operating mode, power-on in a sleep mode, and power-off, the control circuit includes: a first voltage source having a DC voltage that is greater than a nominal forward voltage drop of the light emitting diode, the first voltage source connected to a first resistor in series with an anode of the light emitting diode; a second voltage source having a DC voltage that is greater than the DC voltage of the first voltage source; a first transistor connected between a cathode of the light emitting diode and ground; a control signal connected to an input of the first transistor; a second transistor connected between the first voltage source and the second voltage source, wherein an output of the first transistor is connected to an input of the second transistor.

19 Claims, 7 Drawing Sheets

CONTROL CIRCUIT FOR LIGHT EMITTING DIODE INDICATOR

FIELD OF THE INVENTION

The present invention relates generally to a control circuit for a light emitting diode indicator and more particularly to a control circuit that accommodates both a normal operating mode and a sleep mode in imaging devices for the light emitting diode for efficient energy usage.

BACKGROUND OF THE INVENTION

In recent years, increased attention has been directed toward improved energy efficiency in electronic equipment. International standards such as Energy Star provide energy consumption specifications that a product should meet if it is to be certified.

In order to reduce energy consumption, electronic equipment such as printers, typically have a normal mode during which prints can be made, and a sleep mode during which prints cannot be made. In the sleep mode, power is only supplied to certain key portions of the apparatus so that it operates in a low power consumption mode. For example, power is typically provided to a microcontroller in sleep mode so that it is not necessary to reinitialize the firmware when it is time to re-enter normal operating mode. Thus a sleep mode provides energy savings while permitting rapid availability of the printing capability when needed. Even more power savings is possible by turning off the printer entirely, but turning the printer off results in some delay in the availability of printing capability when the printer is turned back on.

Most electronic equipment includes indicator lights, and in many instances, light emitting diodes (LED's) are used. For example, electronic equipment typically includes an LED that serves as a power indicator light that is turned on when the apparatus is on, and is turned off when the apparatus is off. It is desirable to have an indicator light, such as a power indicator LED, which provides a higher amount of light intensity when the apparatus is in normal operating mode and a lower amount of light intensity when the apparatus is in sleep mode.

LED's have a nominal forward voltage drop from anode to cathode when they are providing light at their typical light intensity and the diode current is in the range of around 10 to 20 mA. At a lower forward voltage, the light intensity is reduced or shut off and the current drops off significantly. LED's that provide light in the mid to long wavelength portion of the visible spectrum (such as red, orange, yellow and green) tend to have nominal forward voltages of around 1.6 volts to 2.2 volts. LED's that provide light in the short wavelength portion of the visible spectrum (such as blue) tend to have nominal forward voltages of around 3 volts. A white LED also typically has a nominal forward voltage of around 3 volts, as a white LED is typically made by coating a blue LED with a phosphor of a different color in order to convert some of the emitted light from short wavelengths to longer wavelengths.

Printing systems typically require DC power at a plurality of different voltages. The printing voltage required for the firing pulses for the drop ejectors in an inkjet printhead, for example, is typically between 10 volts and 50 volts depending upon the design of the drop ejectors. Many printheads include driving and logic electronics that is integrated within the same printhead die that includes the drop ejectors. The logic electronics of the printhead requires a DC voltage that is typically around 5 volts. Motor controllers also typically use 5 volts as do the light sources for a document scanner of a multifunction printer. System logic requires a DC voltage that can be around 3.3 volts. Memory, such as DRAM, can require a DC voltage around 2 volts. For systems having an integrated circuit serving as the microcontroller (sometimes called a system on chip or SOC), a core voltage of around 1 V is typically required for the SOC. During normal operating mode, all of these voltages are available. In sleep mode, the 3.3 volt system logic supply is typically left on, but the higher voltages including 5 volts and the printhead drop ejector printing voltage are turned off in order to save energy.

For some printer designs, it is desirable to use a blue LED or a white LED as a power indicator light. Other colors, such as red, green and yellow can unintentionally deliver messages with different connotations due to the usage of such colors in other contexts. A white or blue LED is a more neutral color that does not distract from the meaning that power is on or off.

Consequently, a need exists for a control circuit for an indicator light, such as a white or blue power indicator LED, which provides a higher amount of light intensity when the apparatus is in normal operating mode and a lower amount of light intensity, using a lower amount of energy, when the apparatus is in sleep mode.

SUMMARY OF THE INVENTION

The present invention is directed to overcoming one or more of the problems set forth above. Briefly summarized, according to one aspect of the invention, the invention resides in a control circuit for a light emitting diode for indicating power-on in a normal operating mode, power-on in a sleep mode, and power-off, the control circuit comprises: a first voltage source having a DC voltage that is greater than a nominal forward voltage drop of the light emitting diode, the first voltage source connected to a first resistor in series with an anode of the light emitting diode; a second voltage source having a DC voltage that is greater than the DC voltage of the first voltage source; a first transistor connected between a cathode of the light emitting diode and ground; a control signal connected to an input of the first transistor; a second transistor connected between the first voltage source and the second voltage source, wherein an output of the first transistor is connected to an input of the second transistor.

In another embodiment, the invention resides in a printer including a normal operating mode and a sleep mode, the printer includes: a light emitting diode; a first voltage source having a first DC voltage; a second voltage source having a second DC voltage that is greater than the first DC voltage; and a control circuit, wherein the control circuit is configured to cause the light emitting diode to emit at a first light intensity when the printer is in sleep mode, and wherein the control circuit is configured to cause the light emitting diode to emit at a second light intensity greater than the first light intensity when the printer is in normal operating mode.

In a third embodiment, the invention resides in a method of operating a printer having a normal operating mode during which prints can be made and a sleep mode during which prints cannot be made, the method includes: using a first voltage source when the printer is in the sleep mode for turning on a light emitting diode; and using a second voltage source when the printer is in the normal operating mode for turning on the light emitting diode, wherein the second voltage is greater than the first voltage.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
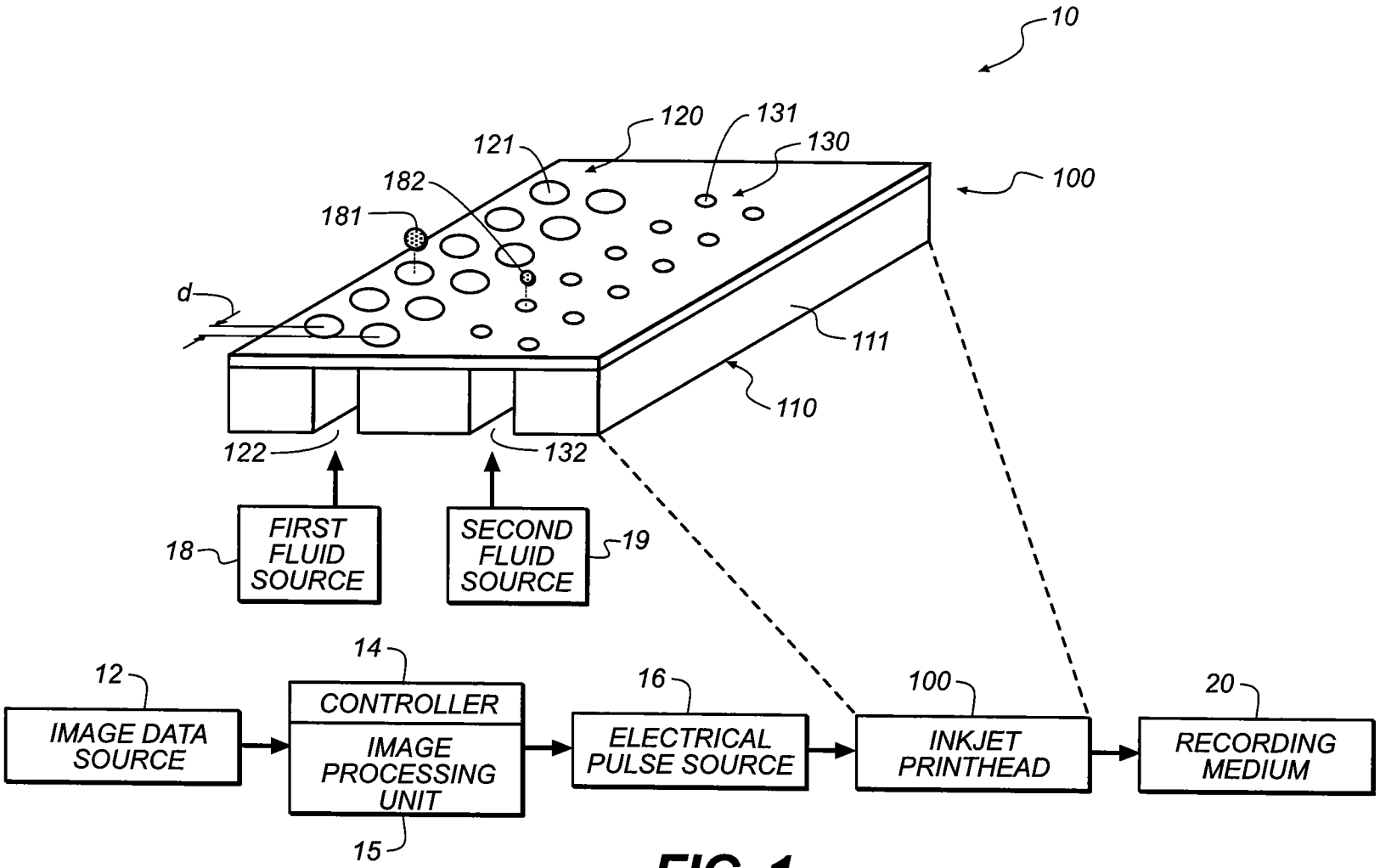
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays 120, 130 has two staggered rows of nozzles 121, 131, each row having a nozzle density of 600 per inch. The effective nozzle density then in each array is 1200 per inch (i.e. $d=1/1200$ inch in FIG. 1). If pixels on the recording medium 20 were sequentially numbered along the paper advance direction, the nozzles 121, 131 from one row of an array would print the odd numbered pixels, while the nozzles 121, 131 from the other row of the array would print the even numbered pixels.

In fluid communication with each nozzle array 120, 130 is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it can be beneficial to have a single fluid source supplying ink to both the first nozzle array 120 and the second nozzle array 130 via ink delivery pathways 122 and 132 respectively. Also, in some embodiments, fewer than two or more than two nozzle arrays 120, 130 can be included on printhead die 110. In some embodiments, all nozzles on inkjet printhead die 110 can be the same size, rather than having multiple sized nozzles on inkjet printhead die 110.

The drop forming mechanisms associated with the nozzles are not shown in FIG. 1. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
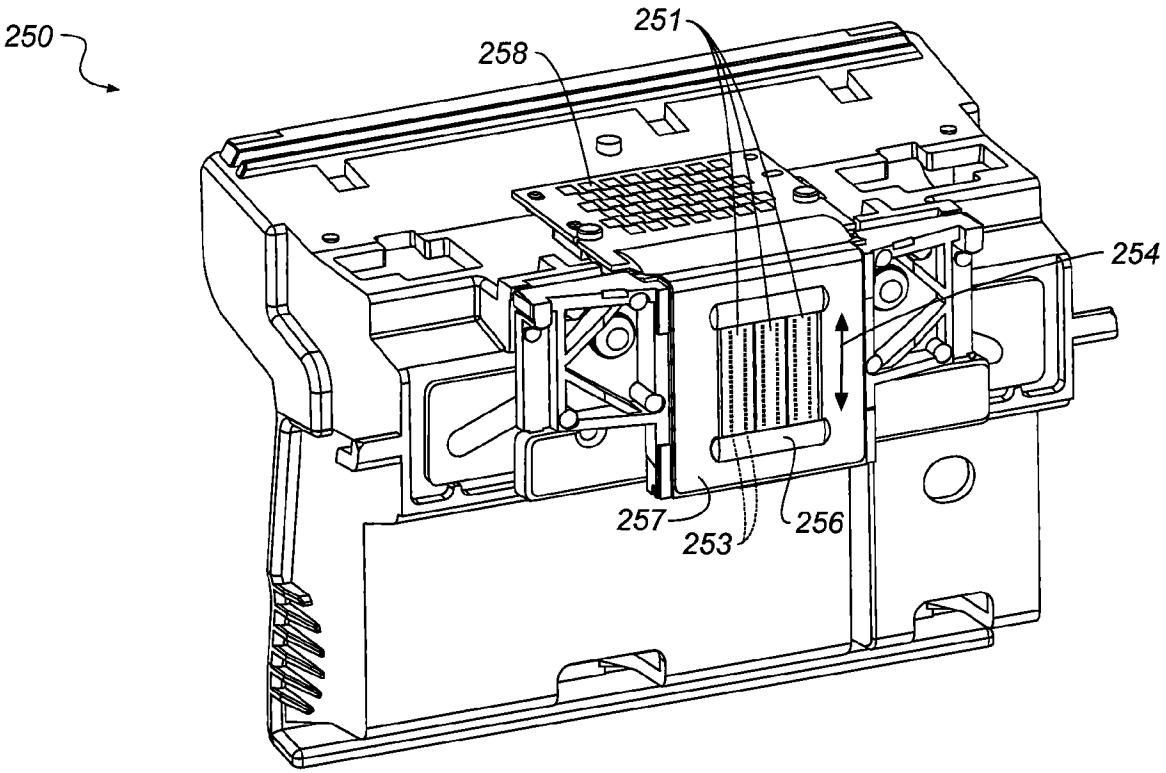
FIG. 2 is a perspective of a portion of a printhead.

FIG. 2 shows a perspective of a portion of a printhead 250, which is an example of an inkjet printhead 100. Printhead 250 includes three printhead die 251 (similar to printhead die 110 in FIG. 1), each printhead die 251 containing two nozzle arrays 253, so that printhead 250 contains six nozzle arrays 253 altogether. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array 253 along the nozzle array direction 254 is typically on the order of 1 inch or less. Typical lengths of recording media 20 are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into the carriage 200 (see FIG. 3), connector board 258 is electrically connected to a connector (not shown) on the carriage 200, so that electrical signals can be transmitted to the printhead die 251.

Figure 3:
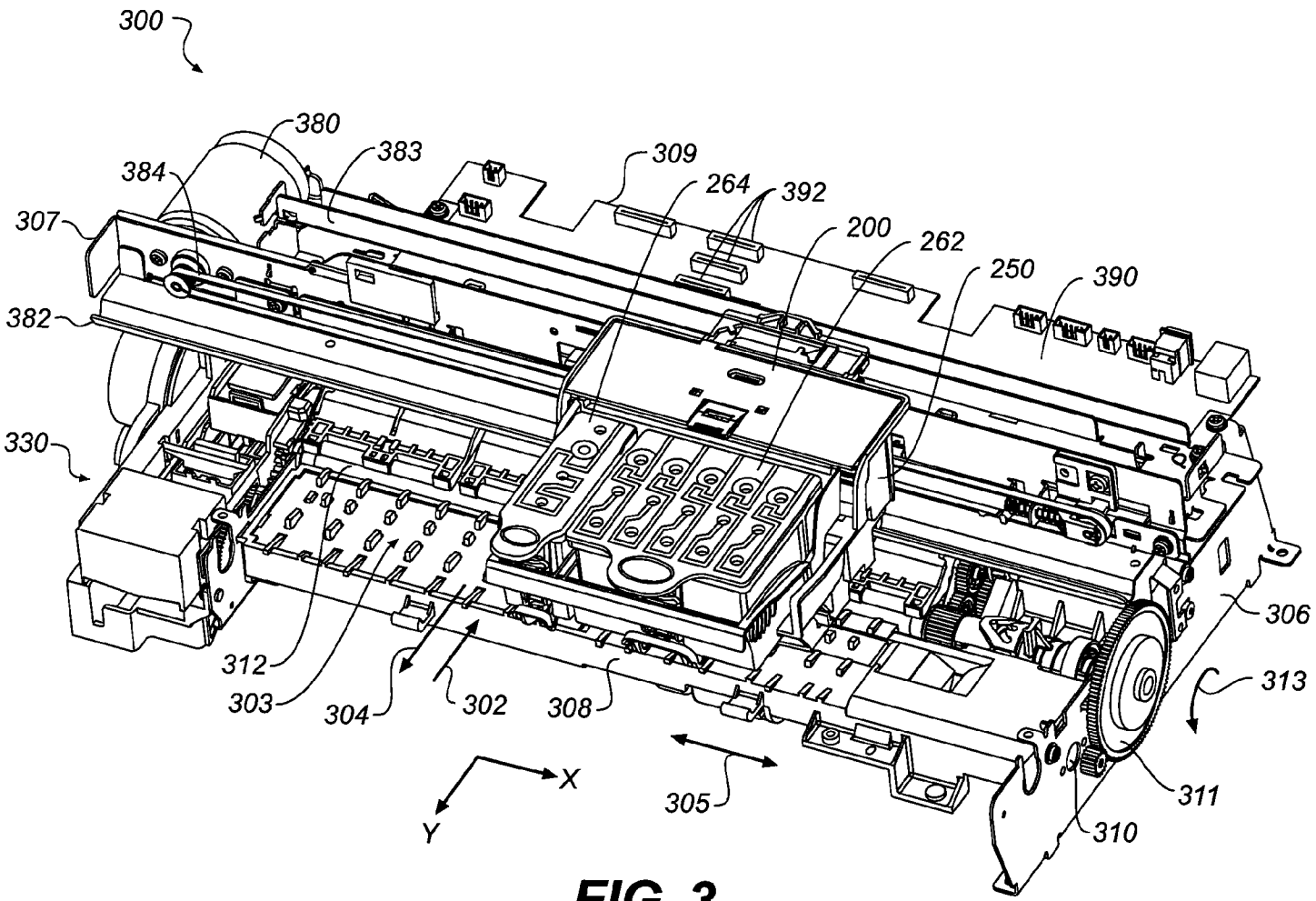
FIG. 3 is a perspective of a portion of a carriage printer.

FIG. 3 shows a portion of a desktop carriage printer. Some of the parts of the printer have been hidden in the view shown in FIG. 3 so that other parts can be more clearly seen. Printing mechanism 300 has a print region 303 across which carriage 200 is moved back and forth in carriage scan direction 305 along the X axis, between the right side 306 and the left side 307 of printing mechanism 300, while drops are ejected from printhead die 251 (not shown in FIG. 3) on printhead 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead 250 is mounted in carriage 200, and multi-chamber ink supply 262 and single-chamber ink supply 264 are mounted in the printhead 250. The mounting orientation of printhead 250 is rotated relative to the view in FIG. 2, so that the printhead die 251 are located at the bottom side of printhead 250, the droplets of ink ejected downward onto the recording medium in print region 303 in the view of FIG. 3. Multi-chamber ink supply 262, in this example, contains five ink sources: cyan, magenta, yellow, photo black, and colorless protective fluid; while single-chamber ink supply 264 contains the ink source for text black. Paper or other recording medium (sometimes generically referred to as paper or media herein) is loaded along paper load entry direction 302 toward the front of printing mechanism 308.

Figure 4:
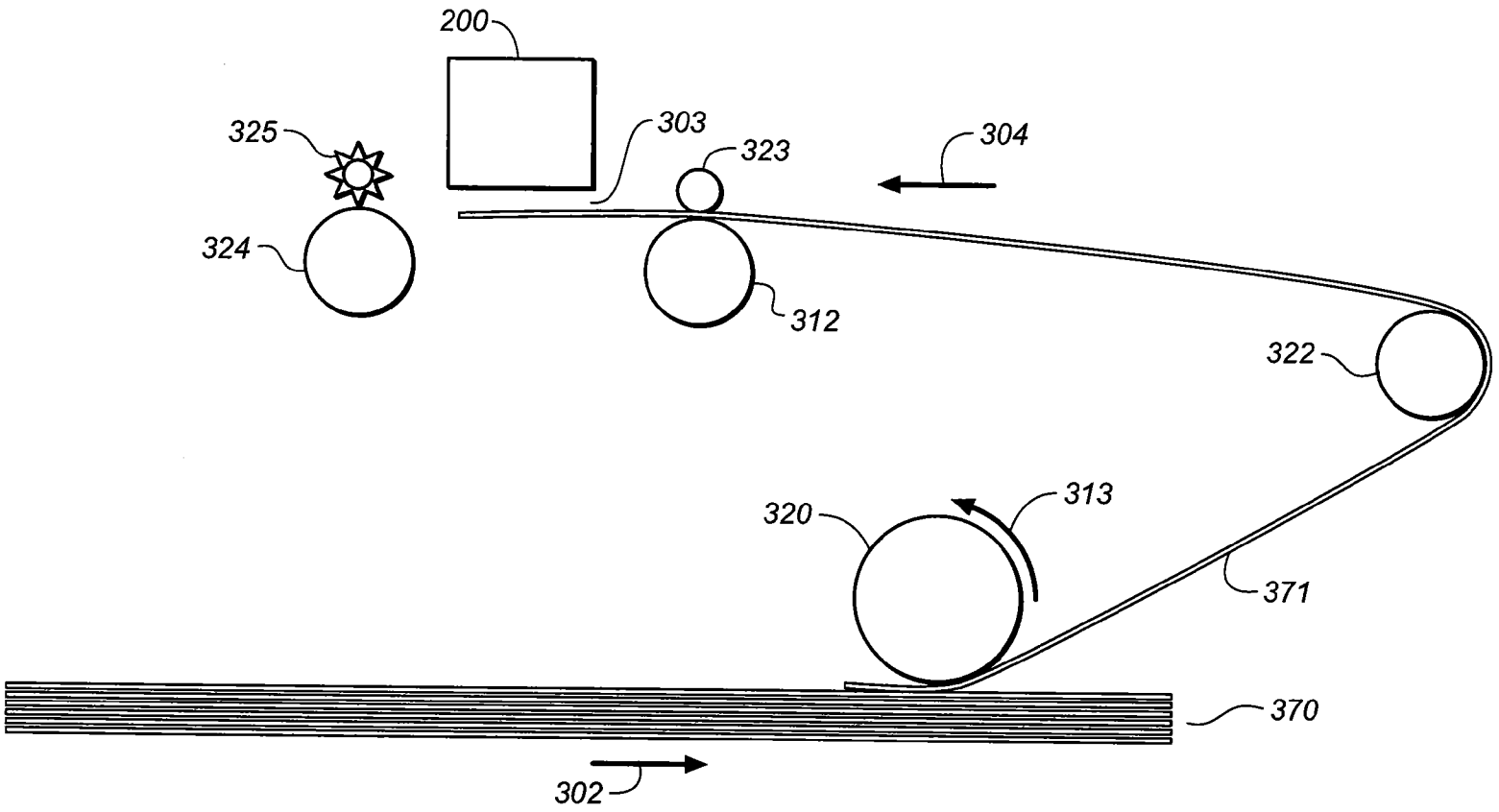
FIG. 4 is a schematic side view of an exemplary paper path in a carriage printer.

A variety of rollers are used to advance the medium through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printing mechanism (with reference also to FIG. 3). The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but the hole 310 at the right side of the printing mechanism 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printing mechanism 307, in the example of FIG. 3, is the maintenance station 330.

Toward the rear of the printing mechanism 309, in this example, is located the electronics board 390, which includes cable connectors 392 for communicating via cables (not shown) to the printhead carriage 200 and from there to the printhead 250. Also on the electronics board 390 are typically mounted motor controllers for the carriage motor 380 and for the paper advance motor, a processor and other control electronics (shown schematically as controller 14 and image processing unit 15 in FIG. 1) for controlling the printing process, and an optional connector for a cable to a host computer.

Figure 5:
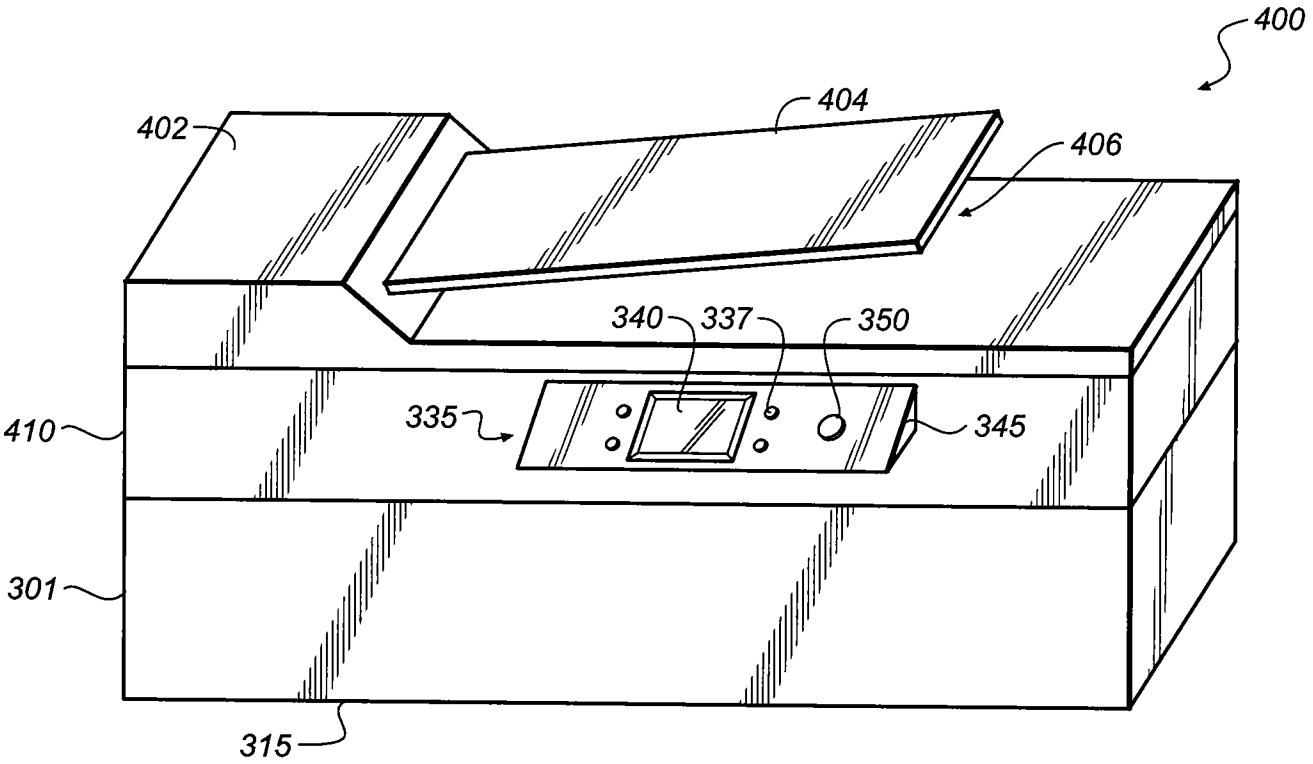
FIG. 5 is a perspective of a multifunction printing apparatus with power indicator light.

FIG. 5 shows a perspective of a multifunction printer 400 having a printing apparatus 301 including a printing mechanism for printing images, such as printing mechanism 300 (FIG. 3), enclosed within a housing 315, and also a scanning apparatus 410 for scanning documents or other items. In the example shown in FIG. 5, multifunction printer 400 includes a control panel 335 having control buttons 337 (including an on/off button) and an indicator light 350 located on the same frame 345 on which the display 340 is located, but indicator light 350 can optionally be located in other locations on multifunction printer 400. Also shown in FIG. 5 is an automatic document feeder 402 for feeding documents for scanning from an input tray 404, past a scanning window (not shown) and into an output tray 406. A scanner light source 456 (FIG. 6) provides illumination to the document scanned so that a photosensor scan assembly (not shown) can convert reflected light from the document into electrical signals.

Figure 6:
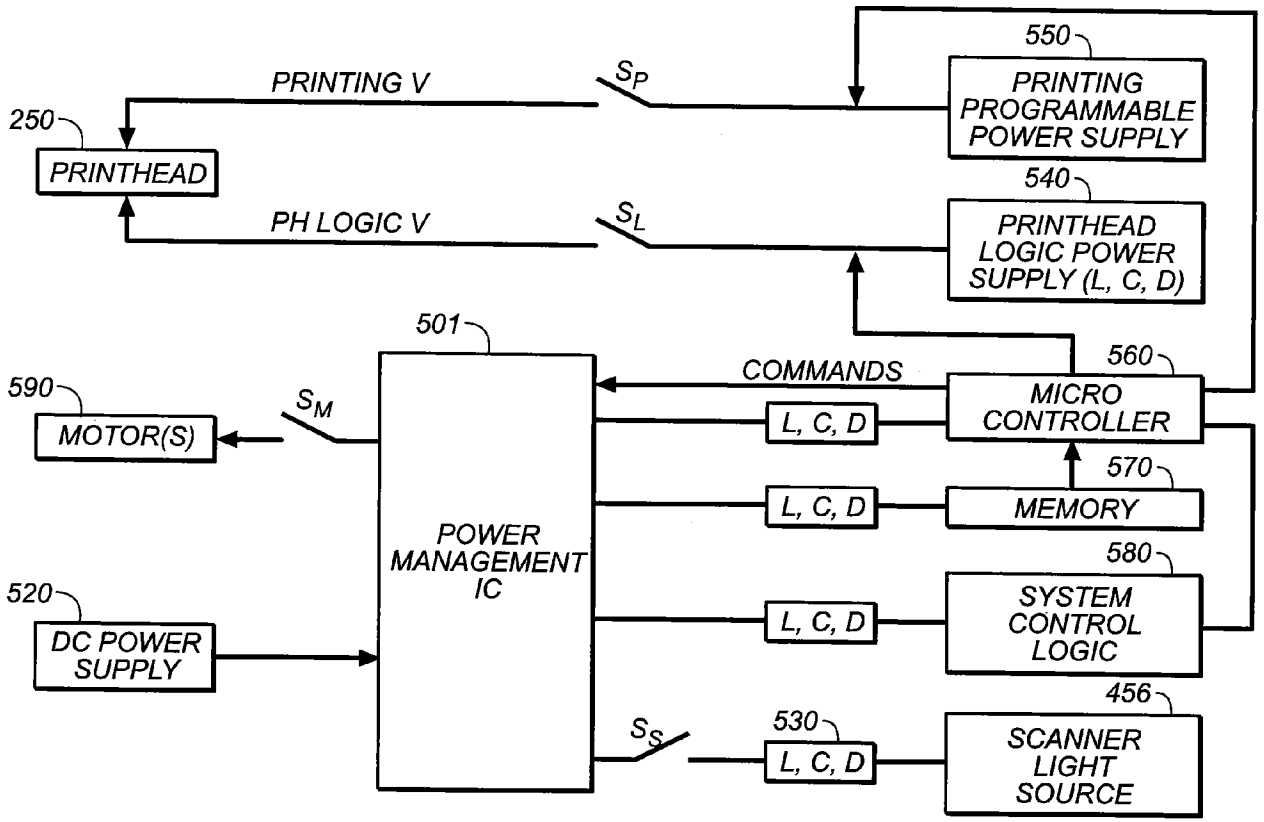
FIG. 6 is a block diagram of power management circuitry for a multifunction printer.

A block diagram of power management circuitry for a multifunction printer is shown in FIG. 6. A DC power supply 520 provides a regulated DC voltage to a power management IC 501. Typically, the voltage provided by DC power supply 520 is approximately equal to the highest DC voltage required in the multifunction printer. Other DC voltage levels are provided by DC to DC conversion. One type of DC to DC conversion circuit is a buck converter (not shown). In the buck converter, when a power transistor is turned on, current begins flowing from the input source $V_{in}$ through the power transistor, through an inductor L, through a capacitor C and into the load. The magnetic field in inductor L builds up, storing energy in the inductor. When the power transistor is turned off, inductor L opposes any drop in current by suddenly reversing its EMF. As a result, it supplies current to the load through a flyback diode D (typically a Schottky diode). The DC voltage $V_{out}$ across the load is the input voltage $V_{in}$ times the switching duty cycle. Although it is possible to provide the buck converter or other type of switching mode power supply for each of the required DC voltages, a more economical approach is to integrate some of the components for each of the DC to DC conversion circuits onto the power management integrated circuit 501. In particular, the power transistors and the switching control circuits can be incorporated into the power management IC 501. Typically, however the inductors L, capacitors C and flyback diodes D are provided as discrete components 530 for each of the different required voltages.

Several different system components are shown in FIG. 6 having different DC voltage requirements. Core voltage for the system on chip microcontroller 560 is typically around 1 volt. The microcontroller 560 (also called a system on chip or SOC herein) not only receives its voltage input from the power management IC 501, but also provides commands to the power management IC 501. Dynamic RAM memory 570 typically requires around 2 volts. System control logic 580 (some or all of which can be incorporated on the microcontroller 560) typically requires around 3.3 volts. ROM memory typically requires around 3 volts for reading and can typically use the same DC voltage source as system control logic 580. The scanner light source 456 for scanning apparatus 410 (FIG. 5) can require around 5 volts. For the various DC voltages provided, (for example, core voltage for the microcontroller 560, voltage for RAM memory, voltage for system control logic circuitry, and the like) power management IC 501 provides a voltage control output that controls the switching through the corresponding discrete inductors, capacitors and diodes (i.e. discrete components 530) to provide the appropriate DC voltage levels.

Power management IC 501 can also controllably provide power to the various motors 590 in the multifunction printer, including the carriage motor 380 (FIG. 3) for moving the carriage 200, a paper advance motor (not shown) for advancing paper or other recording medium 20 through the printing mechanism 300 (FIG. 3), a scan assembly motor for the scanning apparatus 410 (FIG. 5), and a motor for the automatic document feeder 402 (FIG. 5) Some or all of these motors 590 can be run in both forward direction and reverse direction so the motor control circuitry in power management IC 501 is typically more complex than simple on/off switches.

Printhead 250 can require two different voltages. A first DC voltage called printing voltage is required by the dot forming elements in order to make a mark on the recording medium 20. For example, for a thermal inkjet printhead, the printing voltage is the voltage used in pulsing the resistive heater in order to vaporize a portion of ink and thereby cause ejection of a drop from the drop ejector. Depending on the nominal resistance of the resistive heaters on a thermal inkjet printhead, the printing voltage is typically between about ten volts and fifty volts. It is desirable to have the energy dissipated in the resistive heaters to be at or near a predetermined value so that the heaters will reliably nucleate vapor bubbles for drop ejection without overheating the heaters. Because resistive heater power is $V^2/R$ and resistance R can vary from printhead to printhead due to manufacturing variability, a programmable power supply 550 is sometimes used to adjust the voltage V to compensate. For example, if the nominal printing voltage is 28 volts, the printing programmable power supply can be adjusted to provide 30 volts, for example, for a printhead having a higher than nominal heater resistance, or 26 volts, for example, for a printhead having a lower than nominal heater resistance. Typically the printing programmable power supply 550 receives its input voltage from DC power supply 520, although that connection is not shown in FIG. 6. A second DC voltage required by printheads 250 that have integrated logic circuitry is a printhead logic voltage, which is typically around 5 volts. Printhead logic DC voltage source 540 and printing programmable power supply 550 are shown separate from power management IC 501 in FIG. 6, but power transistors and switching control circuitry for these two DC voltage sources can also be partially integrated into power management IC 501.

An on/off switch $S_P$ is typically provided between printing power supply 550 and printhead 250, and an on/off switch $S_L$ is typically provided between printhead logic DC voltage source 540 and printhead 250. During the sleep mode, switches $S_P$ and $S_L$ can be turned off to disconnect printhead 250 from printing power supply 550 and printhead logic DC voltage source 540 respectively during periods of inactivity in order to limit the amount of power that is used by the printhead, thereby improving energy efficiency. Similarly switches $S_M$ and $S_S$ can be turned off to disconnect motors 590 and scanner light source 456 from their power supplies (typically 5 volts) during the sleep mode. Prints cannot be made when the printer is in the sleep mode.

Figure 7:
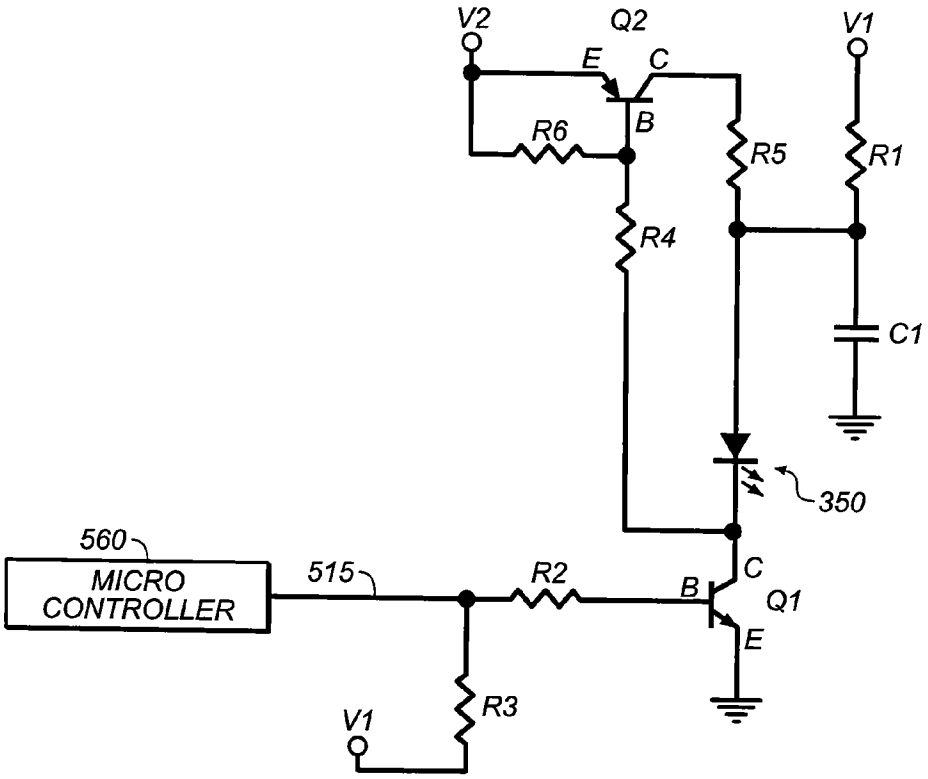
FIG. 7 is a diagram of a control circuit for an indicator light according to an embodiment of the invention.

FIG. 7 is a diagram of a control circuit 510 for an indicator LED 350 according to an embodiment of the invention. Indicator LED 350 can be a power indicator that indicates power-on in a normal operating mode of the apparatus by a bright appearance, power-on in a sleep mode by a dim appearance, and power-off by the absence of emitted light. Control circuit 510 drives indicator LED 350 with a first voltage source V1 when the apparatus is in the sleep mode, and with a second voltage source V2 when the apparatus is in the normal operating mode. For example, indicator LED 350 is typically a white LED or a blue LED having a nominal forward voltage drop of approximately 3 volts when it is fully turned on and emitting light at an intensity that gives it a bright appearance. LED's that provide light in the short wavelength portion of the visible spectrum (such as blue) tend to have nominal forward voltages of around 3 volts. A white LED also typically has a nominal forward voltage of around 3 volts, as a white LED is typically made by coating a blue LED with a phosphor of a different color in order to convert some of the emitted light from short wavelengths to longer wavelengths. Both white LED's and blue LED's emit light having wavelengths less than 530 nanometers.

First voltage source V1 has a DC voltage of 3.3 volts and second voltage source V2 has a DC voltage of 5 volts. Both of these voltages can be provided, for example, as described above with reference to FIG. 6. The DC voltage at V1 (3.3 volts) is only slightly greater than the nominal forward voltage drop (around 3 volts) of the indicator LED 350. Typically, the DC voltage of the first voltage source V1 is greater than the nominal forward voltage of the indicator LED 350 by less than 0.6 volt. The DC voltage at V2 (5 volts) is at least one volt greater than the DC voltage at V1 (3.3 volts). In the normal operating mode V2 is turned on and the 5 volts is sufficient to turn on indicator LED 350 fully so that it emits at a first light intensity having a bright appearance. In the sleep mode, V2 is turned off, as described above relative to FIG. 6 and control circuit 510 causes the indicator LED 350 to be driven from V1. However, as described below, the 3.3 volts at V1 is not able to provide the nominal forward voltage drop for indicator LED 350, so that indicator LED 350 emits at a second light intensity less than the first light intensity, thereby providing a dim appearance. Indicator LED 350 itself also uses less energy in the sleep mode than in the normal operating mode, thereby saving additional energy.

Control circuit 510 includes a first transistor Q1 and a second transistor Q2. In this example both Q1 and Q2 are bipolar junction transistors, which have an advantage of being very economical. The base, emitter, and collector terminals respectively of Q1 and Q2 are labeled B, E and C. First transistor Q1 is an NPN transistor that is connected between the cathode of indicator LED 350, which is connected to the collector C, and ground which is connected to the emitter E. When Q1 is turned off, current does not flow through indicator LED 350 and light is not emitted. A control signal source 515 is provided by microcontroller 560 is connected to an input of first transistor Q1. In particular, control signal 515 is connected to a resistor R2 that is in series with the base of first transistor Q1. The value of R2 is chosen to provide an appropriate amount of base current, but can be 1 kΩ for example. When control signal 515 is driven high by firmware code, first transistor Q1 is turned on and current can flow through indicator LED 350. When control signal 515 is driven low by firmware code, first transistor Q1 is turned off and current cannot flow through indicator LED 350. In some instances it is desirable to have indicator LED 350 blink on and off. Control signal 515 enables such blinking by sequentially providing high and low control signals 515 as directed by firmware.

In the sleep mode, second voltage source V2 is turned off. First voltage source V1 is connected to a current limiting resistor R1 that is in series with the anode of indicator LED 350. Current can flow from V1 (3.3 volts) through R1 through indicator LED 350 and through first transistor Q1 to ground. The collector-emitter voltage drop across first transistor Q1 is approximately 0.3 volt. The value of R1 is chosen depending on the nominal forward voltage of the style of indicator LED 350 that is used in order to permit some current flow through indicator LED 350, providing a low level of light emission and giving a dim appearance, but not permitting indicator LED 350 to turn on fully. A typical value of R2 is around 200Ω for a nominal forward voltage of 2.9 volts.

Second transistor Q2 is a PNP transistor and is connected between first voltage source V1 (e.g. 3.3 volts) and second voltage source V2 (e.g. 5 volts). An output of first transistor Q1, for example the collector of first transistor Q1, is connected to an input of second transistor Q2, for example the base of second transistor Q2. A resistor R4 is connected in series between the collector of first transistor Q1 and the base of second transistor Q2. The value of R4 is chosen to provide an appropriate amount of base current to second transistor Q2 to turn it on when first transistor Q1 is turned on in the normal operating mode when second voltage source V2 is on. A typical value for R4 is around 3 kΩ. The emitter of second transistor Q2 is connected to the second voltage source V2, and the collector of second transistor Q2 is connected in series with current limiting resistor R5 that is in series with the anode of the indicator LED 350. The value of R5 is chosen to provide an appropriate level of current to flow through indicator LED 350 when second transistor Q2 is turned on in the normal operating mode in order to permit indicator LED 350 to turn on fully and emit light at an intensity that gives it a bright appearance while not permitting excessive current to flow that might damage indicator LED 350. The emitter of the second transistor Q2 is connected to a resistor R6 that is in series with the base of the second transistor Q2. When first transistor Q1 is off, it can have a small amount of leakage current. Resistor R6 is provided so that such leakage current is not able to turn on second transistor Q2 when first transistor Q1 is off. By connecting the base and emitter of second transistor Q2 through a resistor R6, the base to emitter voltage is approximately 0, thereby not permitting second transistor Q2 to turn on inadvertently. A typical value of R6 is around 3 kΩ.

In normal operating mode, second voltage source V2 (5 volts) is turned on. Control circuit 510 uses second voltage source V2 to drive indicator LED 350 fully on to emit light at an intensity that provides a bright appearance, Control circuit 510 can make indicator LED 350 blink on and off by sending appropriate control signals 515 from microcontroller 560 at the directions of firmware. When control signal 515 is low, first transistor Q1 is off and no current can flow through indicator LED 350 so that no light is emitted. When control signal 515 is high, first transistor Q1 is turned on, which also cause second transistor Q2 to turn on, as described above. Current flows from second voltage source V2 through second transistor Q2 through resistor R5 through indicator LED 350 and through first transistor Q1 to ground. The DC voltage (5 volts) at second voltage source V2 is sufficient to fully turn on indicator LED 350, taking into account its nominal forward voltage, as well as the voltage drops across second transistor Q2, first transistor Q1 and resistor R5.

Control circuit 510 also provides a reasonable amount of isolation between the first voltage source V1 and the second voltage source V2 in the normal operating mode. The nominal forward voltage of an indicator LED of interest is 2.9 volts. Adding in the collector C to emitter E voltage drop of about 0.3 volts across first transistor Q1, the anode of indicator LED 350 is at approximately 3.2 volts. This is sufficiently close to the DC voltage (3.3 volts) of first voltage source V1 that current flows mainly from second voltage source V2 and only a small amount of current flows from first voltage source V1 through indicator LED 350. There can be some manufacturing variability in LED's. Some LED's of the same variety having a nominal forward voltage of 2.9 volts can have a forward voltage of up to 3.1 volts. The voltage at the anode of such an LED would be approximately 3.1 volts+0.3 volts=3.4 volts. This is slightly greater than the DC voltage at first voltage source V1 so that a small amount of current can flow from the second voltage source V2 to the first voltage source V1. However, resistors R1 and R5 provide sufficient isolation between first voltage source V1 and second voltage source V2 even in such instances.

When switching first transistor Q1 on and off, or switching between normal operating mode and sleep mode, some amount of electrical noise can be produced. Capacitor C1 is provided to reduce the noise.

A final feature of control circuit 510 to be described herein is the resistor R3 that is connected in series between first voltage source V1 and resistor R2 that is in series with the base of first transistor Q1. This portion of the control circuit 510 permits rapid turn on of indicator LED 350 when a main power supply (not shown) is switched from off to on. When the main power supply is off, no power is supplied to microcontroller 560. When the main power supply is turned back on, firmware needs to take some time to initialize, resulting in a delay before control signal 515 can be driven high in order to turn on first transistor Q1. Such a delay, resulting in a delay of turning on indicator LED 350 can confuse a user into thinking the user has not actually turned on the apparatus, so that the user pushes the on/off button again and turns the apparatus back off. During power-on reset when the main power supply is switched from off to on, the output pads of the microcontroller 560 are in a high impedance mode so that the 3.3 volts from V1 goes through R3 and R2 (thereby bypassing microcontroller 560) to provide an appropriate amount of base current to turn on first transistor Q1 without delay, thus turning on indicator LED 350 immediately. After microcontroller 560 is operational, if control signal 515 is low, the base of first transistor Q1 is connected to ground through R2, so first transistor Q1 is shut off. A small amount of current (typically less than 1 mA) flows from first voltage source V1 through R3 into microcontroller 560. However, this is well below the acceptable current limit.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
250 Printhead
251 Printhead die
253 Nozzle array
254 Nozzle array direction
256 Encapsulant
257 Flex circuit
258 Connector board
262 Multi-chamber ink supply
264 Single-chamber ink supply
300 Printing mechanism
301 Printing apparatus
302 Paper load entry direction
303 Print region
304 Media advance direction
305 Carriage scan direction
306 Right side of printing mechanism
307 Left side of printing mechanism
308 Front of printing mechanism

309 Rear of printing mechanism
310 Hole (for paper advance motor drive gear)
311 Feed roller gear
312 Feed roller
313 Forward rotation direction (of feed roller)
315 Housing
320 Pick-up roller
322 Turn roller
323 Idler roller
324 Discharge roller
325 Star wheel(s)
330 Maintenance station
335 Control panel
337 Control button
340 Display
345 Frame
350 Indicator LED
370 Stack of media
371 Top piece of medium
380 Carriage motor
382 Carriage guide rail
383 Encoder fence
384 Belt
390 Printer electronics board
392 Cable connectors
400 Multifunction printer
402 Automatic document feeder
404 Input tray
406 Output tray
410 Scanning apparatus
456 Scanner Light Source
501 Power management IC
510 Control circuit
515 Control signal
520 DC power supply
530 Discrete components
540 Printhead logic DC voltage source
550 Printing programmable power supply
560 Microcontroller
570 Memory
580 System control logic
590 Motors
d density
V Voltage
V1, V2 Voltage Source
Q1, Q2 Transistor
B Base
C Collector Terminal
E Emitter
R1, R2, R3, R4, R5, R6 Resister
SL, SM, SP, SS Switches

The invention claimed is:

1. A printer including a normal operating mode and a sleep mode, the printer comprising:

a light emitting diode;

a first voltage source having a first DC voltage;

a second voltage source having a second DC voltage that is greater than the first DC voltage; and a control circuit, wherein the control circuit is configured to cause the light emitting diode to emit at a first light intensity when the printer is in sleep mode, and wherein the control circuit is configured to cause the light emitting diode to emit at a second light intensity greater than the first light intensity when the printer is in normal operating mode; wherein the control circuit includes a first transistor connected between cathode of the light emitting diode and ground; a control signal connected to an input of the first transistor; and a second transistor connected between the first voltage source and the second voltage source, wherein an output of the first transistor is connected to an input of the second transistor.

2. The printer of claim 1, wherein the first voltage source has a DC voltage that is greater than a nominal forward voltage drop of the light emitting diode, and wherein the first voltage source is connected to a first resistor in series with an anode of the light emitting diode.

3. The printer of claim 1, wherein the first transistor is an NPN transistor and the second transistor is a PNP transistor.

4. The printer of claim 3, wherein the control signal is connected to a second resistor in series with a base of the first transistor.

5. The printer of claim 4, wherein the control signal is provided by a microcontroller.

6. The printer of claim 5, wherein the first voltage source is connected in series with a third resistor that is in series with the second resistor.

7. The printer of claim 3, wherein a collector of the first transistor is connected in series with a fourth resistor that is in series with a base of the second transistor.

8. The printer of claim 7, wherein the collector of the first transistor is connected to the cathode of the light emitting diode.

9. The printer of claim 3, wherein an emitter of the second transistor is connected to the second voltage source, and wherein a collector of the second transistor is connected in series with a fifth resistor that is in series with the anode of the light emitting diode.

10. The printer of claim 9, wherein the emitter of the second transistor is connected to a sixth resistor that is in series with the base of the second transistor.

11. The printer of claim 1, wherein the nominal forward voltage of the light emitting diode is approximately 3 volts.

12. The printer of claim 1, wherein the DC voltage of the first voltage source is greater than the nominal forward voltage of the light emitting diode by less than 0.6 volt.

13. The printer of claim 1, wherein the DC voltage of the second voltage source is at least one volt greater than the DC voltage of the first voltage source.

14. The printer according to claim 1, wherein the light emitting diode emits white or blue light.

15. The printer according to claim 1, wherein the second voltage source is used to turn on the light emitting diode in the normal operating mode, and wherein the first voltage source is used to turn on the light emitting diode in the sleep mode.

16. The printer according to claim 1, wherein the first DC voltage is 3.3 volts and the second DC voltage is 5 volts.

17. A method of operating a printer having a normal operating mode during which prints can be made and a sleep mode during which prints cannot be made, the method comprising:

using a first voltage source when the printer is in the sleep mode for turning on a light emitting diode; and using a second voltage source when the printer is in the normal operating mode for turning on the light emitting diode, wherein the second voltage is greater than the first voltage; wherein turning on a light emitting diode includes using a microcontroller and a control circuit to turn the light emitting diode on and wherein turning on a light emitting diode further includes bypassing the microcontroller when a main power supply of the printer is switched from off to on.

18. The method according to claim 17 further comprising turning off the second voltage source when the printer is in the sleep mode.

19. The method according to claim 17, wherein turning on a light emitting diode includes causing the light emitting diode to emit light at wavelengths less than 530 nanometers.

* * * * *